United States Patent [19]

Berg

[11] 4,233,713

[45] Nov. 18, 1980

[54] LOCKABLE BUCKLE FOR BELTS, STRAPS AND THE LIKE

[76] Inventor: Odd Berg, Myntvägen 9, S-890 23 Själevad, Sweden

[21] Appl. No.: 905,826

[22] Filed: May 15, 1978

[30] Foreign Application Priority Data

May 2, 1978 [SE] Sweden ..... 7805073

[51] Int. Cl.[3] ..... A44B 11/12

[52] U.S. Cl. ..... 24/191; 24/170

[58] Field of Search ..... 24/171, 194, 170

[56] References Cited

U.S. PATENT DOCUMENTS

| | | | |
|---|---|---|---|
| 44,693 | 10/1864 | Tattershall | 24/170 |
| 252,092 | 1/1882 | Fluck | 24/171 |
| 565,396 | 8/1896 | Stansbury | 24/171 |
| 708,359 | 9/1902 | Clements | 24/171 |
| 904,707 | 11/1908 | Meinhardt | 24/194 |
| 2,287,722 | 6/1942 | Beazley | 24/170 |
| 2,334,462 | 11/1943 | White | 24/194 |
| 2,442,266 | 5/1948 | Davis | 24/194 |
| 2,517,424 | 8/1950 | Griswold | 24/170 |
| 3,152,374 | 10/1964 | Round | 24/194 |
| 3,276,085 | 10/1966 | Spranger | 24/171 |

FOREIGN PATENT DOCUMENTS

| | | | |
|---|---|---|---|
| 934522 | 5/1948 | France | 24/194 |
| 446791 | 3/1968 | Switzerland | 24/170 |
| 15973 | of 1914 | United Kingdom | 24/194 |

*Primary Examiner*—Roy D. Frazier
*Assistant Examiner*—Robert W. Gibson, Jr.
*Attorney, Agent, or Firm*—Blanchard, Flynn, Thiel, Boutell & Tanis

[57] ABSTRACT

A lockable buckle for belts, straps and the like, consisting of an exterior housing, or shoe, accommodating a freely movable locking slide which forms, between it and the inside of the housing, a locking area for nipping a belt or the like passing through the buckle. One end of the slide is drawn out into a curved portion hooked onto and partially surrounding an eccentric cam means turnable by an operating arm and arranged to press this end of the slide against the belt during locking. The opposite end of the slide has a transverse slot through which the belt passes for access to the locking area between the slide and the shoe, the tension in the belt pressing this end of the slide against the belt.

16 Claims, 11 Drawing Figures

LOCKABLE BUCKLE FOR BELTS, STRAPS AND THE LIKE

The present invention relates to lockable buckles for belts, straps, bands and the like, here referred to as belts, more precisely such buckles which exercise their locking action by friction and are taken from a locked position to an open or free position, and vice versa, by means of a manual operating means.

Belt buckles of different kinds are already known, such a buckle being attached for example, to one end of a belt, while the other end of the belt is threaded through an opening in the buckle to form a running portion, which can be nipped in the buckle in an optional position, e.g. by an eccentric mechanism, a wedge, a rocker plate or the like. In such cases, the buckle is most often self-locking, i.e. the locking force increases when the belt is subjected to load, by the portion of the belt running through the buckle being subjected to the wedging action.

Although these known buckles all have their disadvantages and inconveniences during use, they have functioned acceptably for belts of "classic" materials such as leather, cotton, hamp, balata, reinforced rubber etc. These known buckles are meanwhile not suitable for use together with belts of modern synthetic material, such as amide plastics or polyester plastics (trade names nylon, terylene etc.), because these materials have rather low surface friction, and are sensitive to local compressive stresses, when the material easily becomes plastically deformed. In the known buckles, the belt will namely be subjected to a locally restricted nipping action causing the material to deform and yield which, in combination with the low surface friction, results in that the belt starts to creep in the buckle. In actual fact, there are at the present time no buckles of the friction type on the market, suitable for belts made from plastics.

The invention has the object of providing a new belt buckle of the kind in question, especially suitable for use together with belts made from the modern plastics materials, said buckle coacting firmly and immovably with the belt so that the latter does not glide when the buckle is in the locked position. It is further intended to provide a belt with a manual operating means by which the buckle can be brought into two states or positions, namely a free position, in which the belt can run freely through the buckle, and a locked position in which the belt is immovably clamped in the buckle without risk of gliding. The operating means shall also act positively, i.e. so that when the means is moved to its free position, the belt will really be released, irrespective of whether it is under load or not. As is generally known, there is often the disadvantage in conventional belt buckles locked by friction that they are "self-locking" also in the sense that when under load they wedge the belt so tightly that it cannot be loosened without being first unloaded. The object is achieved and a belt buckle wherein the above-mentioned disadvantages are circumvented is provided by the buckle according to the invention.

The invention will now be described by way of example, while referring to the attached drawings, on which FIG. 1 shows different views (end view, plan view and longitudinal section) of an outer housing or shoe, referred to here as a shoe, included in the buckle according to the invention.

FIGS. 1*a* and 1*b* show detail modifications of the shoe according to FIG. 1.

FIG. 2 shows a pin and

FIG. 3, using the same views as in FIG. 1, shows a slide included in the buckle.

Figure 5:
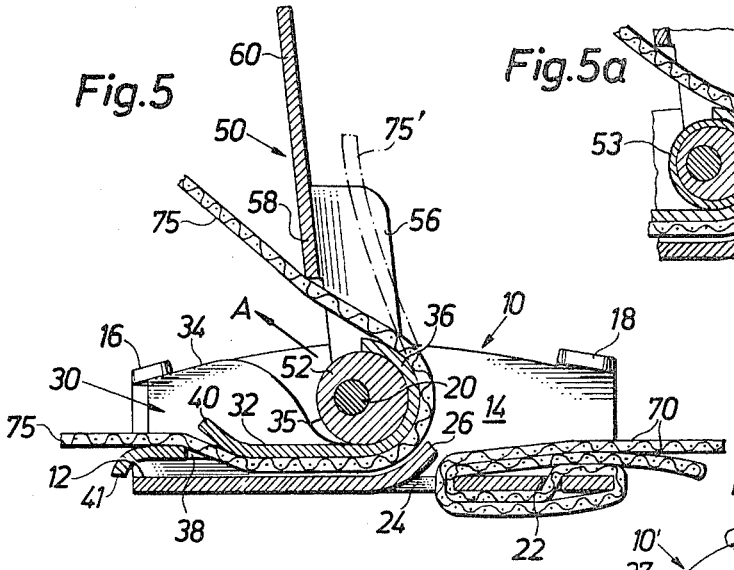
FIG. 5 shows a longitudinal section on an enlarged scale through the assembled buckle according to the invention in the open or free position, and in coaction with a belt.
Figure 5A:
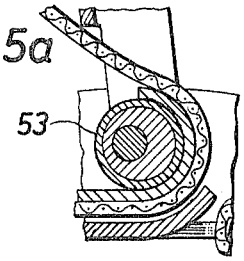

FIG. 5*a* shows a portion of a section corresponding to FIG. 5, but with the buckle provided with a modified operating means.

Figure 1:
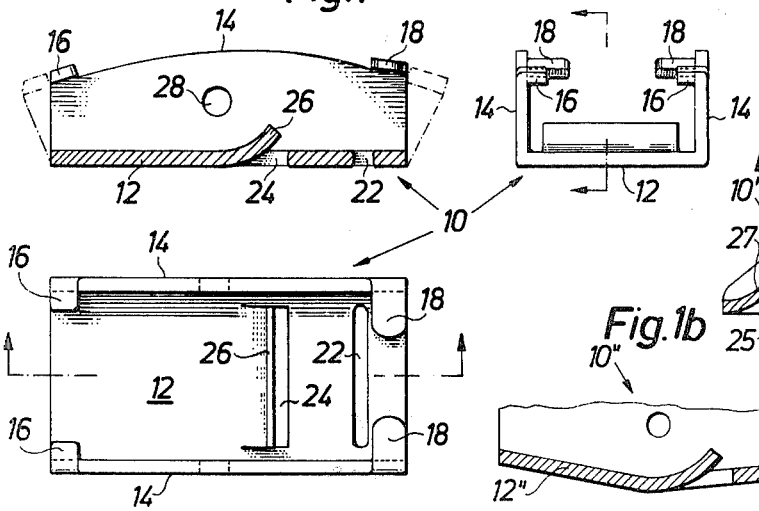
Figure 1A:
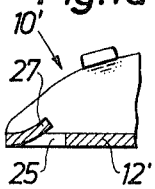
Figure 5B:
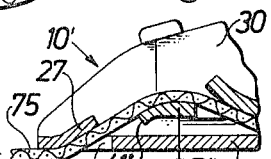

FIG. 5*b* shows a detail section of the assembled buckle, with the shoe modified according to FIG. 1*a*.

Figure 6:
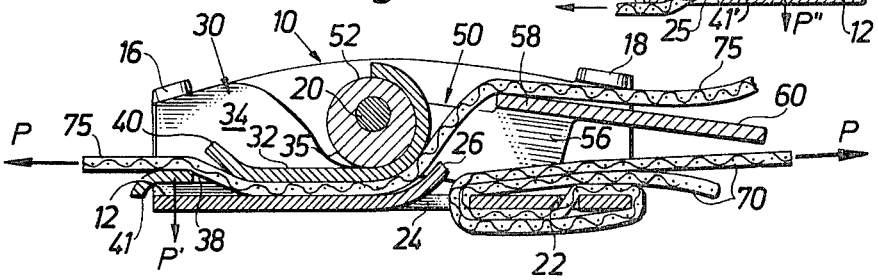
Figure 7:
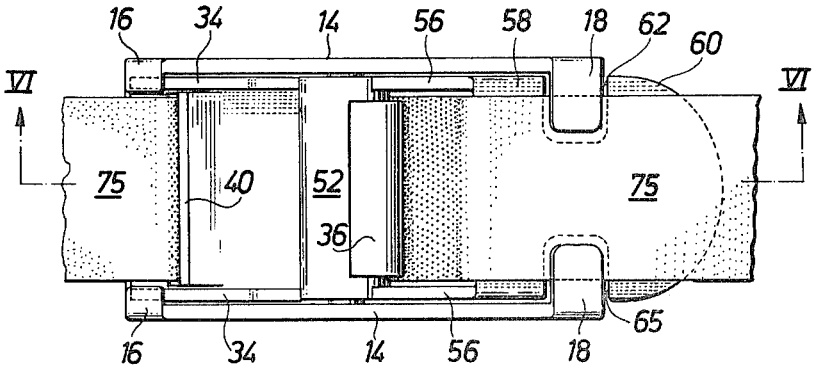

FIG. 6 is a longitudinal section through the buckle according to FIG. 5, but showing the buckle in the locked position, the section being noted by the line VI—VI in FIG. 7, which shows a plan view of the buckle with a coacting belt, in the locked position.

Figure 2:
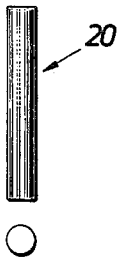

The buckle according to the invention comprises three main parts, namely a housing, or shoe, 10 (FIG. 1), a slide 30 (FIG. 3) movable in the shoe and an operating or locking arm 50 (FIG. 4) journalled in the shoe 10 by means of a pin 20 (FIG. 2). The coaction of the different parts will be described in detail in the following.

The shoe 10, see FIG. 1, has the general configuration of an upwardly open U-shaped plate with a web or bottom 12 and two upstanding flanges or cheeks 14. At the ends of the shoe there are pairs of inwardly bent ears 16 (to the left in the figure) and 18 (to the right in the figure) arranged at the upper edges of the cheeks 14, the ears 16 being somewhat smaller and shorter than the ears 18 and directed so that their undersides are at a small angle to the bottom 12 of the shoe. There are two openings in the bottom of the shoe, the first opening 22 having the shape of a slot extending perpendicular to the longitudinal direction of the shoe, over the majority of its bottom, and close to the end of the shoe where the ears 18 are situated. A second opening 24 is arranged in the shoe, spaced inwardly from the first opening, similarly extending perpendicular to the longitudinal direction of the shoe and along the greater part of the width of the bottom 12. The opening 24 has suitably been made by forcing up a lip 26 from the bottom 12, the lip being given a rounded cross section, as is apparent from FIG. 1. Both openings 22 and 24 have a length corresponding to the width of the belt intended for use with the buckle, as will be described in the following. Bearing apertures 28 for the pin 20 (FIG. 2) are arranged opposite each other in the cheeks 14 of the shoe.

Figure 1B:
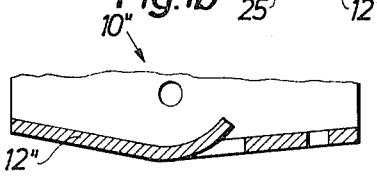

FIGS. 1*a* and 1*b* illustrate some modifications of the shoe according to FIG. 1. In FIG. 1*a*, the bottom portion 12' of the shoe 10' is extended somewhat to the left, seen on the drawing, a transverse opening or slot 25 being made in this extended bottom portion, preferably by pressing a lip 27 up from the portion, as is clearly shown in FIG. 1*a*. The slot 25 also has a length corresponding to the width of the belt intended for use with the buckle. According to FIG. 1*b*, the shoe 10'' is provided with a rounded bottom portion 12'' which can either be continuously curved or, as shown in FIG. 1*b*, made up from two substantially straight portions forming a certain angle to each other.

Figure 3:
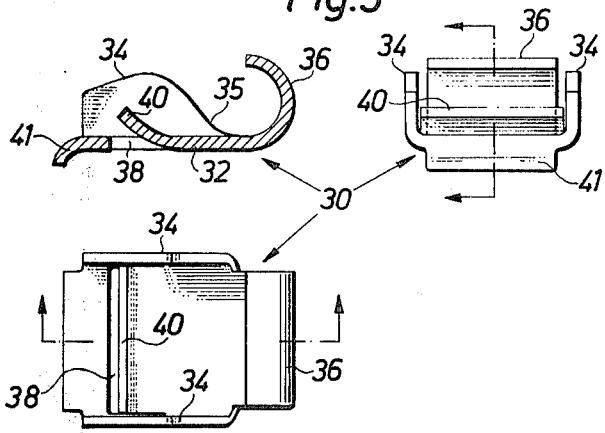

The movable slide 30, seen in FIG. 3, also has a substantially U-shaped cross section and consists of a bottom portion 32 with upstanding flanges or cheeks 34, the upper edges of which are made with substantially the same inclination as the above-mentioned ears 16 on the shoe 10. The righthand end of the bottom portion in the figure is extended and bent upwards into a circular tongue 36, while its lefthand end is also extended but bent downwardly into a shorter tongue 41. Between the cheeks 34 there is an opening 38, made in the bottom 32 by a lip 40 having been pressed up from the bottom between the cheeks, as is clearly apparent from FIG. 3. The outside width of the slide 30 over the cheeks 34 is so adjusted that the slide is accommodated with a running fit between the upstanding cheeks 14 of the shoe 10, and the length of the opening or slot 38, i.e. the interior distance between the cheeks 34, corresponds to the width of the belt intended for use with the buckle.

Figure 4:
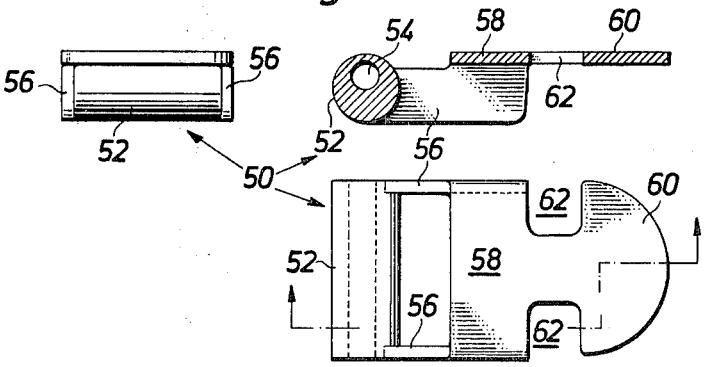
FIG. 4 shows, similarly with views as in FIGS. 1 and 3, the operating means or locking arm of the buckle.

Finally with regard to the locking arm 50, as seen in FIG. 4, this consists of a substantially cylindrical, eccentrically journalled cam portion 52, to the ends of which are attached opposing side pieces 56. The free ends of the latter are united by a bridge 58 extending along the upper edges of the side pieces, as is apparent from FIG. 4, and continuing outwardly in the form of a thumb-piece or handle 60, which is otherwise separated from the bridge by recesses 62 taken up on either side. The cylindrical cam portion 52 is provided with a through-going bearing bore 54, excentrically situated and adapted slidingly to accomodate the above-mentioned pin 20. The length of the cam portion 52, i.e. the outisde width of the locking arm 50 in its entirety, is so adjusted that the arm fits between the cheeks 14 of the shoe 10 with inconsiderable play.

The assembly of the buckle and its coaction with an associated belt will now be described while referring to FIGS. 5–7. The slide 30 is placed between the cheeks 14 of the shoe 10 so that it is in the lefthand, as viewed in the figures, part of the shoe and with its lefthand end lying under the ears 16 of the shoe. The locking arm 50 is placed between the shoe cheeks 14 with its bearing bore 54 in line with the bearing openings 24 in the shoe. The pin 20 is inserted into the openings and retained in position in a suitable way, not more closely shown. The cylindrical cam portion 52 of the locking arm 50 will now be accommodated inside the circular tongue 36 of the slide 30, the interior curvature of the tongue being such that it fits round the cylindrical surface of the cam portion 52, as shown in FIG. 5. As may be seen, the cheeks 34 of the slide 30 are made with their righthand sides sloping, the cam portion 52 thereby being accommodated between the lower portion of these sloping sides 35 and the inside of the upwardly bent tongue 36. When the pin 20 is removed, the locking arm 50 with its cam portion 52 can be lifted out of the slide in the direction of the arrow A, possibly after having first eased up the upper end or tip of the tongue 36.

As will be seen, the excentric mounting of the cam portion 52 is such that when the locking arm 50 is moved to stand substantially straight upwards, as shown in FIG. 5, the cam portion will push the slide 30 somewhat to the right and upwards compared with a position in which the locking arm is swung, clockwise according to the drawing, to a substantially horizontal position shown in FIG. 6. In the latter position, the slide is thus pressed generally downwards by the excentric cam portion 52, and thereby engages with the coacting belt for locking, as will be described.

In principle, the buckle according to the invention can be used to connect two separate belts, one belt being firmly anchored in the buckle while the other is arranged to run through it. The most usual case is, however, that the buckle is used together with a belt in one piece, one end portion 70 of which forms an anchoring portion fixed to the buckle, see FIG. 5 and FIG. 6. The belt portion 70 is thus attached to the righthand bottom portion 12 of the shoe 10, this attachment taking place in an optional manner, e.g. by riveting the belt end fast to the bottom or by threading the belt through the opening 22 for riveting or sewing back onto itself in a loop which goes round the portion of the bottom 12 separated by the opening 22. However, the belt end can to great advantage be threaded a couple of times between the openings 22 and 24 so that the belt forms a double turn, e.g. as shown in FIGS. 5 and 6. To do this, the free belt end 70 is first threaded from the top and downwards through the opening 24, then round the end of the bottom portion 12, down through the opening 22 and back again to the opening 24, here to be threaded upwardly through this opening so that the free belt end finishes up just outside the shoe, under the portion of the belt 70 coming from this end. When the belt is tightened, the configuration shown in FIGS. 5 and 6 is obtained, giving the belt an immovably fixed anchorage on the buckle. This arrangement has naturally the great advantage that there is no dependence on sewing or riveting, the belt can be cut to an optional desired length, and if a belt made from plastics is used, the threads in the end which has been cut off can be melted together and sealed with the flame from a matchstick or other open flame. By subsequently threading the belt a few times between the openings 22 and 24, as already mentioned, there is rapidly obtained a fixed and completely glide-proof connection to the shoe 10 of the buckle.

The other, free end 75 of the belt is threaded in through the other end of the buckle, as shown in FIG. 5, i.e. from above and downward through the opening 38 in the bottom 32 of the slide 30, and further in between the underside of the slide and the upper side of the bottom 12, subsequently to continue upwards around the outside of the curved tongue 36 of the slide. It is necessary that the belt be taken down through the opening 38, it must not be pushed directly in under the slide 30. For this purpose, the bottom portion of the slide is extended with the downwardly bent tongue 41, which thus prevents such incorrect threading of the belt. The belt portion 75 is then suitably drawn further out between the side pieces 56 of the locking arm 50 and through the opening formed between the bridge 58 and cam portion 52 of the locking arm, as shown with full lines in FIG. 5. However, if it is suitable in some cases, the belt can continue straight out as denoted by chain dotted lines at 75' in FIG. 5 (although before future locking, the belt must be threaded through said opening between the bridge 58 and the cam portion 52, as should be apparent from the following). The belt can now be tensioned, e.g. by it being placed around some object which is to be slung, with its running portion 75 being drawn through the buckle, which is now in its open position shown in FIG. 5, where the belt can run freely between the underside of the slide 30 and the upper side of the bottom 12 of the shoe 10.

When the belt has been pulled tight as heavily as possible, it is locked in the buckle by bringing the locking arm 50 down into its locked position shown in FIG. 6. As seen, the cam portion 52 passes the slide 30 downwards by its eccentric action and into engagement with the belt, which is then clamped against the bottom 12 of the shoe. At the same time, the lefthand end of the slide is pressed downward by the tension P in the belt 75, see FIG. 6, since this curves downward through the opening 38 in the slide. The belt tension thus has a downwardly directed component P′ acting towards the left end of the slide with the result that the clamping force on the belt is distributed more evenly along the slide. The upper edges of the cheeks 34 of the slide can also engage against the underside of the sloping ears 18 of the shoe with a certain wedging action, since the eccentric cam portion 52 also moves the slide 30 somewhat to the left when locking. By this engagement between the ears 16 and the slide, its lefthand end will be further pressed downwards for clamping against the belt. If so desired, and to ensure said sideways displacement of the slide, the edges 35 (see FIG. 5) of the cheeks 34 adjacent the cam portion 52 can be arranged to partially engage with the cam portion so that the slide is positively displaced to the left, seen on the drawing, when locking takes place.

In summary, it may be stated that the slide is thus heavily pressed against the belt during the locking and, due to its action on both ends of the slide, the clamping force will be fairly equally distributed over the slide without the occurrency of point loads which could damage the belt. To increase the frictional effect, the surfaces of the buckle engaging with the belt can be provided with a friction-increasing coacting, or they can be treated in some other way e.g. by roughing-up or knurling.

During locking, the cam portion 52 of the locking arm 50 glides against the inside of the curved tongue 36 of the slide, as mentioned, and by suitable selection of material, the least possible friction is strived for. Friction can also be minimized the surrounding the cam portion 52 with a ferrule of suitable material which is inserted between the cam portion and the tongue 36, as illustrated in FIG. 5*a*.

The clamping action described above, which the tension in the belt 75 exercises on the lefthand end of the slide, can be further reinforced if the shoe is modified as shown in FIG. 1*a*. In this case the lefthand portion of the assembled buckle will have the appearance as shown in FIG. 5*b*. The lefthand end of the shoe 10′ is thus somewhat extended, and its bottom is provided here with the further slot 25, the belt 75 being caused to enter the buckle through this slot as shown in FIG. 5*b*. The slide 30′ used in this case has a tongue 41′, which is very short or is dispensed with altogether, since the risk of incorrect threading in this embodiment of the belt is insignificant. Otherwise, the belt passes through the slide in the same way as before, and it will clearly be seen from FIG. 5*b* that the belt tension P is given a component P″, acting downwardly on the lefthand end of the slide 30′, this component being considerably reinforced in comparison to the component P′ in the embodiment according to FIG. 6. A still further improvement of the clamping action is obtained if the shoe 10″ is formed with a curved bottom 12″ according to FIG. 1*b*.

After locking, i.e. when the thumb grip or handle 60 of the locking arm assumes its downwardly turned position shown in FIGS. 6 and 7, the righthand ears 18 of the shoe 10 are above the locking arm handle 60, since the above-mentioned recesses 62 between the thumb piece and bridge 58 are so placed that they provide free passage for the ears 18 when the locking arm is pushed downwards. The free belt portion 75 going away from the belt can now be easily threaded in between and under the ears 18, to a position between them and the thumb-piece 60 as shown in FIG. 7. The locking arm is hereby effectively prevented from unintentional movement towards the open position, since the belts itself forms a barrier to this movement. It is pointed out, however, that the tension P in the belt, said tension acting on the cam portion 52 of the locking arm via the slide 30, has no tendency to turn the locking arm to the open position, but it is naturally a great advantage even so that the locking arm can be protected in this simple way against outside action, which could cause the arm to be unintentionally thrust up towards the open position.

As mentioned above, it is a great advantage with the buckle according to the invention that it can be easily released even if it is under full load. When the locking arm 50 is swung anticlockwise, i.e. from the position shown in FIG. 6 to the one shown in FIG. 5, the cam portion 52 forces the slide 30 to glide forwards/upwards because of its eccentric action, resulting in the slide easing from the belt. The movement thus takes place compulsorily and the belt can now be freely pulled through the buckle.

With regard to the material in the buckle according to the invention, this is naturally suitably a metal, referably steel for large loads and heavy belts. Belts made from the modern plastics materials have a remarkable loading capacity, and as is apparent from the above description and drawings, the buckle according to the invention can be made extremely compact and robust. The load is transmitted through the buckle practically directly between the belt portions which are coupled together, without occasioning sharp stress variations or extreme moments in the buckle components. For light belt material, the buckle according to the invention can very well be made of suitable strong plastics material, and thereby form an extremely convenient and non-bulky coupling element for such light belts. The design of the buckle can here be easily adapted so that its components are suitable for injection moulding or compression moulding in tools of a simple matrix and patrix type. Thus, the shoe 10 of the buckle can be formed so that, for example, the ears 16 and 18 at the ends of the buckle will be vertically outside the bottom 12 of the shoe, as is indicated by chaindotted lines in FIG. 1, the remaining portions of the buckle being adjusted hereto. The buckle can also be produced by precision casting in light material.

The belt buckle according to the invention is naturally not limited to the embodiments described and shown, and one skilled in the art ought to be able to suggest, within the purview of the invention, further variations and modifications.

I claim:

1. A lockable buckle for belts, straps and the like comprising an exterior shoe and a locking means accommodated therein and movable between a locked position and an open position for permitting a belt or the like to pass freely through the shoe in the opened position of the locking means and alternately for becoming locked and fixed in the shoe under friction at an optional place along the belt when the locking means is moved into the locked position, said locking means comprising (a) a movable slide in the shoe, the slide forming with the inside of the shoe a locking area through which the belt passes for nipping in the locked position between the slide and the shoe, and (b) a cam means pivotally mounted in the shoe and actuated by an operating arm, said cam means being engageable with the slide adjacent the exit end of said slide, for pressing the slide against the belt on assuming the locked position, and for lifting the slide from the belt when assuming the open position, said buckle being further comprised in that the slide is freely accommodated in the shoe, said slide including at its said exit end a portion partially surrounding the cam means for said lifting of said slide from said belt, said slide including adjacent its opposite entry end a transverse opening adapted to the cross section of said belt to form an entry opening to the said locking area for the belt.

2. A buckle as claimed in claim 1, in which the shoe extends beyond the entry end of the slide and is there provided with a transverse opening, adapted to the cross section of the belt coacting with the buckle, to form an entry opening to the buckle for the belt.

3. A buckle as claimed in claim 2, in which the transverse opening in the portion of the shoe outside the slide is formed in the bottom portion of the shoe, by pressing up a lip from said shoe bottom portion.

4. A buckle as claimed in claim 2, in which the inside of the bottom portion of the shoe is concavely depressed and has a substantially continuously curved surface.

5. A buckle as claimed in claim 1, in which the belt-nipping surface of at least one of the shoe and slide has friction-increasing means.

6. A lockable buckle for belts, straps and the like comprising an exterior shoe and a locking means accommodated therein and movable between a locked position and an open position for permitting a belt or the like to pass freely through the shoe in the opened position of the locking means and instead for becoming locked and fixed in the shoe under friction at an optional place along the belt when the locking means is moved into the locked position, said locking means comprising (a) a movable slide in the shoe, the slide forming with the inside of the shoe a locking area through which the belt passes for nipping in the locked position between the slide and the shoe, and (b) a cam means pivotally mounted in the shoe and actuated by an operating arm, said cam means being engageable with the slide adjacent the exit end of said slide, for pressing the slide against the belt on assuming the locked position, and for lifting the slide from the belt when assuming the open position, said buckle being further comprised in that the slide is freely accommodated in the shoe, said slide including at its said exit end a portion partially surrounding the cam means, said slide including adjacent its opposite entry end a transverse opening adapted to the cross section of said belt to form an entry opening to the said locking area for the belt, in which the shoe is open-ended with a U-shaped cross section and has a bottom portion with upstanding cheeks between which the slide is accommodated, the slide having a U-shaped cross section and a bottom portion with upstanding cheeks, the extended portion of the exit end of the slide having a curved tongue formed from an extension of the slide bottom portion bent up from the plane of said bottom portion.

7. A buckle as claimed in claim 6, in which the bottom portion of the slide, at its entry end opposite said curved tongue, is drawn out to a short tongue which is bent out from the plane of the slide bottom portion in the opposite direction to that of the curved tongue.

8. A buckle as claimed in claim 6, in which the cam means is mounted in the cheeks of the shoe by pin means and includes a cam portion extending between said cheeks for engaging said curved tongue of the slide, whereat side pieces attached to said cam portion extend perpendicularly away from the ends thereof to a handle portion which with the side pieces forms the operating arm of the cam means, the distance between the side pieces allowing passage of the belt coacting with the buckle, between the cam portion and the handle portion.

9. A buckle as claimed in claim 8, in which the cam portion has the shape of an eccentrically mounted cylinder and engages the curved tongue and adjacent portions of the cheeks of the slide.

10. A buckle as claimed in claim 8, in which said cam portion is eccentrically mounted and cylindrical and engages with the slide by the intermediary of an intermediate bearing ferrule surrounding the cam portion.

11. A buckle as claimed in claim 8, in which the handle portion of the cam means is united with the cam portion thereof in such a position that a part of the handle portion in the locked position of the buckle is accommodated between the cheeks of the shoe, the shoe at its exit end having two opposingly directed ears attached to the upper edge of the shoe cheeks, the handle portion being provided with free openings in the form of recesses for allowing said ears to give passage to the handle portion when locking the buckle, the perpendicular distance between the ears and the handle portion in the locked position being sufficiently great for the belt coming from the buckle to be accommodated between the ears and the handle portion.

12. A buckle according to claim 6, in which the bottom portion of the shoe close to its exit end has two parallel transverse slots adapted in shape and size to the cross section of the belt so that the belt is allowed passage through the slots.

13. A buckle as claimed in claim 12, in which said shoe slot closest to the slide is defined, along its portion facing the slide, by a lip standing up from the shoe bottom portion, the inside of the lip being curved and generally conforming to the shape of the belt as the latter passes over the outside of the bottom portion and tongue of the slide.

14. A lockable buckle for belts, straps and the like comprising an exterior shoe and a locking means accommodated therein and movable between a locked position and an open position for permitting a belt or the like to pass freely through the shoe in the opened position of the locking means and instead for becoming locked and fixed in the shoe under friction at an optional place along the belt when the locking means is moved into the locked position, said locking means comprising (a) a movable slide in the shoe, the slide forming with the inside of the shoe a locking area through which the belt passes for nipping in the locked position between the slide and the shoe, and (b) a cam means pivotally mounted in the shoe and actuated by an operating arm, said cam means being engageable with the slide adjacent the exit end of said slide, for pressing the slide against the belt on assuming the locked position, and for lifting the slide from the belt when assuming the open position, said buckle being further comprised in that the slide is freely accommodated in the shoe, said slide including at its said exit end a portion partially surrounding the cam means, said slide including adjacent its opposite entry end a transverse opening adapted to the cross section of said belt to form an entry opening to the said locking area for the belt, in which the shoe has fixed cam surfaces at the entry end of the slide, the slide in locking position engaging said cam surfaces, the latter being so directed that the entry end of the slide is thrust toward the belt by said engagement.

15. A buckle as claimed in claim 14, in which the upper edges of the cheeks of the slide slope in relation to the bottom portion of the slide, at least at the entry end of the slide, for engaging with said cam surfaces of the shoe, said shoe cam surfaces being formed on ears projecting inwardly over the slide, said ears being arranged on the cheeks of the shoe at least near the entry end of the shoe.

16. A lockable buckle for belts, straps and the like, comprising:

an exterior shoe;

a slide movably supported in said shoe, the slide forming with the inside of said shoe a locking area through which a belt passage extends, the slide having a locked position for nipping the belt between the slide and shoe;

a cam means pivotally mounted in the shoe and actuated by an operating arm, the cam means being engageable with the slide adjacent the exit end of said slide for pressing the slide against the belt in said locked position, and for lifting the slide from said belt to the open position of said slide, the exit end of said slide including a portion partially surrounding said cam means, the opposite entry end of said slide having a transverse slot of cross section to receive the belt therethrough and form an entry opening for the belt into said locking area;

said slot being spaced inward of the end of the shoe to always lie opposed to the floor of said shoe, such that a portion of the belt in said slot opposes said floor of said shoe, the entry edge of said slot positively lifting said belt off said floor of said shoe;

said slide including a platelike bottom portion urged adjacent the exit end of said locking area toward its locked position by said cam means, the platelike bottom portion of said slide being urged at its entry end toward its locked position by tensioning the belt resting on the slot entry edge, said entry end of said slide bottom portion defining the exit edge of said slot, said shoe having means retainably engaging said slide at a location offset along the belt path away from said cam means beyond the slot in said slide, said slot thus being spaced between said cam means and retainably engaging means.

* * * * *